United States Patent [19]

Caldwell

[11] 3,981,532

[45] Sept. 21, 1976

[54] FOLDABLE FURNITURE

[76] Inventor: John W. Caldwell, 1829 Warwick Road, San Marino, Calif. 91001

[22] Filed: July 7, 1975

[21] Appl. No.: 593,366

[52] U.S. Cl. ..... 297/42; 248/167

[51] Int. Cl.[2] ..... A47C 4/00

[58] Field of Search ..... 297/42, 44, 45, 35, 297/36, 16; 248/167, 174

[56] References Cited

UNITED STATES PATENTS

| | | | |
|---|---|---|---|
| 929,213 | 7/1909 | Gullickson | 297/42 |
| 933,624 | 9/1909 | Chandler | 297/36 |
| 1,238,142 | 8/1917 | Hitchcock | 248/167 X |
| 1,344,097 | 6/1920 | Stransky | 297/42 |
| 2,338,567 | 1/1944 | Barron | 248/174 |
| 3,346,317 | 10/1967 | Peggs | 248/174 X |

FOREIGN PATENTS OR APPLICATIONS

| | | | |
|---|---|---|---|
| 57,515 | 2/1913 | Austria | 297/36 |

*Primary Examiner*—James C. Mitchell
*Attorney, Agent, or Firm*—Donald D. Mon

[57] ABSTRACT

A foldable article of furniture which has four elongated side members, each having a pair of ends. Hinge means is attached to each of the ends, whereby hingedly to connect adjacent ones of the side members in a quadrilateral array. The opposite side members are substantially equal in length so that the array as viewed in plan is rectangular, and the construction can be folded through a parallelogram configuration, at least to approach a flattened configuration. A transverse member which can serve as a seat support is hingedly attached to one of the side members in such manner that it can be moved to enter the inside of the quadrilateral array and can also be moved to a position outside of it. Stop means is provided on one of the side members and is disposed, proportioned and arranged so as to support the transverse member from below at some position of the transverse member inside the rectangular array. In some embodiments, stop means projects from one of the side members, and a recess is provided in the other so as to receive the stop means when the device is in its folded configuration.

17 Claims, 9 Drawing Figures

10
12
15
13
21
11
14

3
13
10
17
18
12
14
36
21
35
16
19
11
3

10
22
20
21
23
35
31
30

10

12
21
11

14
19
25
24
11

13
12
14
11
21
10

40
42
45
41
43
44

53
54
10
51
50
52

51
52

FOLDABLE FURNITURE

This invention relates to foldable furniture.

Bulky articles of furniture, such as heavy rattan frames, are expensive to ship because of the large cubic volume which their "envelope" occupies. However, the volume actually occupied by the structural members themselves is relatively small, and it therefore would be advantageous to fold the furniture so that it occupies a lesser envelope size when being shipped. Previously known means for folding furniture have not been suitable for bulky pieces of furniture, and it is an object of this invention to provide a construction wherein this type of furniture can be folded to occupy a lesser envelope volume for shipment or storage.

An article of furniture according to this invention includes four elongated side members, each of which has a pair of ends. Hinge means is attached to each of these ends, whereby hingedly to connect adjacent ones of the side members in a quadrilateral array. Opposed side members in pairs are substantially equal in length so that the array, viewed in plan, is rectangular. This array can be folded through a parallelogram configuration, at least to approach a flattened configuration. A transverse member is hingedly attached to one of the side members in such manner that it can be moved to enter the inside of the quadrilateral array and can also be moved to a position outside of it. Stop means is provided on one of the side members and is so disposed, proportioned and arranged as to support the transverse member from below at some position of the transverse member inside the rectangular array.

The above and other features of this invention will be fully understood from the following detailed description and the accompanying drawings, in which.

Figure 1:
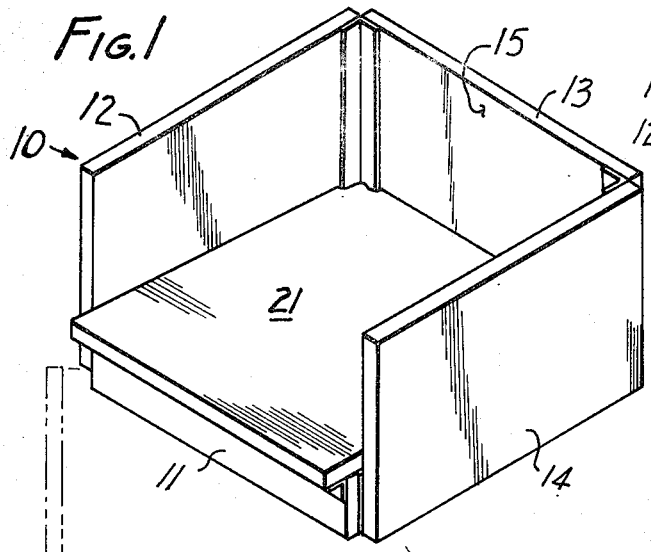
FIG. 1 is an oblique view of a generically-illustrated article of foldable furniture according to the invention.

FIG. 1 shows an article 10 of furniture in the nature of a chair. The article is shown generically, to represent an envelope within which furniture frames of any desired configuration would ordinarily be contained, and serves to illustrate that when such an article of furniture is erected, it occupies a very substantial cubic volume for shipping purposes. Other configurations of a chair readily fit within the envelope. The side members might be rattan structures, or flat or curved shapes. It is to be understood that the showing in the drawings is merely schematic so as to illustrate the invention in its broadest form.

The chair includes a plurality of elongated side members 11, 12, 13, 14. The term "elongated" refers to a dimension running along the floor to form a perimeter. The side members include an internal reference surface 15 such as shown on side member 13. This also is a generic term which indicates a surface closest to the interior which is likeliest to be contacted by a body occupying the region inside the side members. In the illustration shown, were the furniture to be built of flat planar side members, it would be the continuous planar inside surface. Were each member to comprise a group of joined-together vertical posts, then the internal reference surface would be the most internal portion of each one of these posts. Other examples can readily be devised within the preview of this invention.

Hinge means 16, 17, 18, 19 are provided which hingedly interconnect adjacent side members in pairs. For example, hinge means 16 interconnects side members 11 and 12. Hinge means 17 interconnects side members 12 and 13. Hinge means 18 interconnects side members 13 and 14. Hinge means 19 interconnects side members 11 and 14. Any suitable type of hinge can be used, but in many articles of furniture, a flexible sheet of material joined by nailing, gluing or otherwise to the respective side members will be both suitable and attractive.

Figure 3:
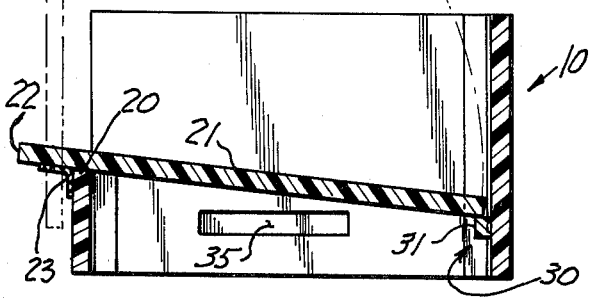
FIG. 3 is a cross-section taken at line 3—3 of FIG. 2.

It will be noted that side member 11 has a lesser height than the other side members. This provides a sill 20 across which a transverse member 21 extends so as to form a lip 22 which juts outwardly beyond side member 11 when the article is in its erect configuration as shown in FIG. 1. Hinge means 23 hingedly joins the transverse member to side member 11 as shown. Also as shown in FIG. 3, the transverse member in all embodiments may have an erected position as shown in solid line and a stored (folded) position as shown in dotted line.

Figure 2:
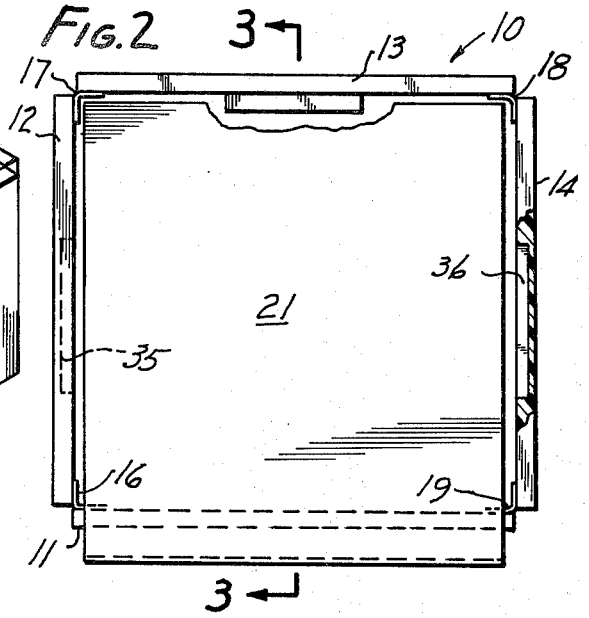
FIG. 2 is a top view of FIG. 1.
Figure 4:
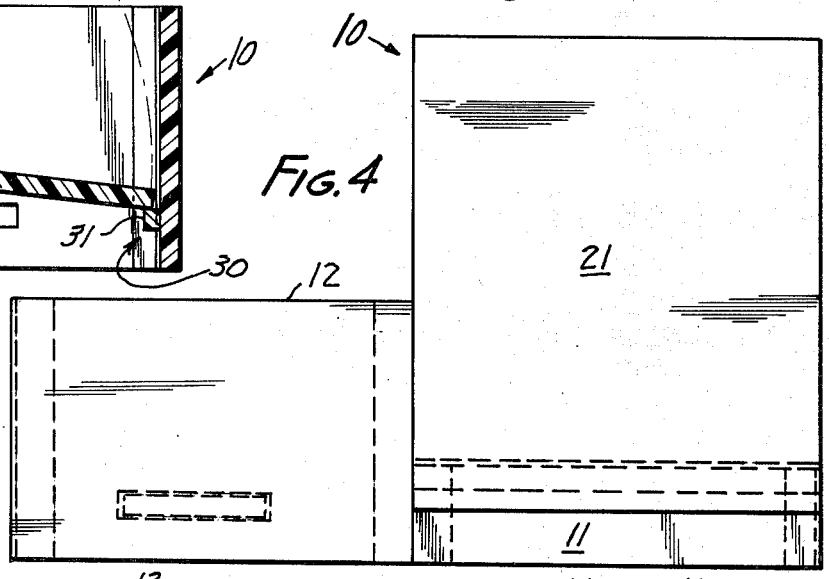
FIG. 4 shows the device of FIG. 1 in its folded configuration.
Figure 5:
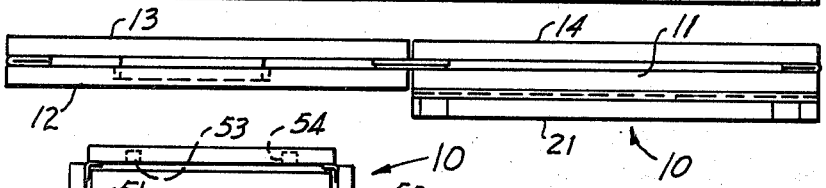
FIG. 5 is a top view of FIG. 4.

The elongated side members are joined in a quadrilateral array, and opposite side members in pairs are substantially equal in length. Accordingly, the array when viewed in plan view as in FIG. 2 is rectangular (it may or may not be square) and the array can be folded through a parallelogram configuration at least to approach a flattened configuration. The "quadrilateral" configuration is defined by the corners, rather than by the actual contours of the side members. The folded configuration is shown in FIGS. 4 and 5. The term "folded" means the most flattened configuration which the article can assume.

Figure 6:
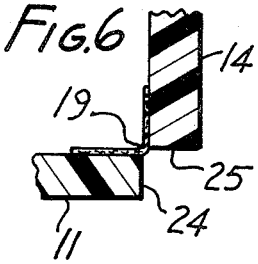
FIG. 6 is a fragmentary cross-section of a typical corner hinge assembly.

In order to permit folding to be accomplished in both directions, the corners are relieved as shown in FIG. 6. That is to say that the ends 24, 25 of side members 11 and 14, as examples, terminate at the hinge means 19 so that the side members can be aligned with one another. When all four corners are similarly relieved, the folding can be done in both directions.

Stop means 30, comprising a stop 31, is attached to the rear side member 13, in FIGS. 1–5 so that it projects into the region bounded by the side members. It is so disposed, proportioned and arranged as to support the transverse member from below at some position of the transverse member inside the rectangular array. For example, the position of FIGS. 1 and 2, where it may be used as a seat, to support a user or support a cushion upon which the user will rest.

As best shown in FIG. 2, at least one but preferably both of the side members 12 and 14 are provided with recesses 35, 36. These are so disposed and arranged as to receive at least part of the stop when the article of furniture is folded. When a recess is provided, in only one side member, folding may be possible in only one direction. When recesses are provided in two side members, folding may be done in both directions.

The stop may be attached to its respective side frame by fasteners, by wrappings, or any other suitable means.

Figure 7:
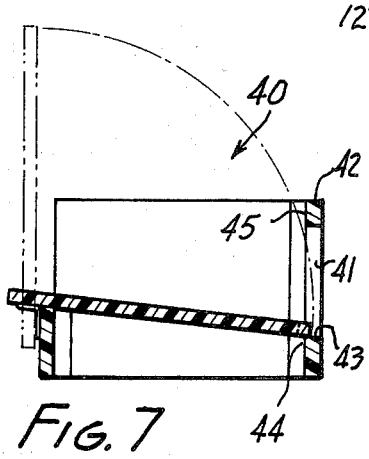
FIG. 7 is a center cross-section of another embodiment of the invention.

FIG. 7 shows another article 40 according to the invention which is identical to that of FIG. 1 with the exception that a recess 41 in the rear side member 42 defines a surface 43 upon which the transverse member can rest as shown in FIG. 7. The recess is tall enough that tongue 44, which forms part of the transverse member, can swing through an arc in the recess 41 without striking the furniture while it does so. In the construction of FIG. 1, a tongue is shown on the transverse member. This is provided more for conformation to the inside walls of the side members than to enter a recess because there is no recess in that embodiment. The recess in FIG. 7 is formed outwardly relative to the reference surface 45 of side member 42.

Figure 8:
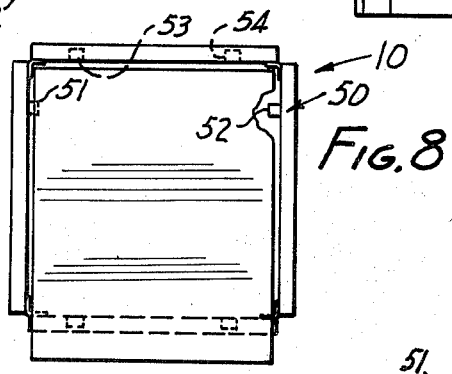
FIG. 8 is a top plan view, partly in cutaway section, of still another embodiment of the invention.
Figure 9:
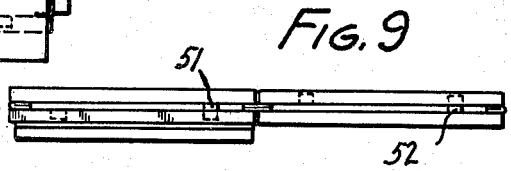
FIG. 9 is a top view of the article of FIG. 8 in its folded configuration.

FIG. 8 shows another embodiment of the invention which bears the same reference numbers as the article of FIG. 1. In this embodiment, the stop means 50 comprises at least one and preferably two posts 51, 52 which project into the inside area bounded by the side frame members whereby to provide a surface atop which the transverse member can rest and be supported. Recesses 53, 54 are formed respective to posts 51 and 52 to receive them at least in part. The folded configuration is shown in FIG. 9. The recesses and stops should be so disposed, arranged and proportioned that with the transverse member up and out of the cavity as defined by the side members, the side members may be moved through a parallelogram configuration at least to approach the flattened configuration shown in FIGS. 5 and 9.

According to a preferred feature of the invention, the shape of the transverse member is such that it has a width somewhere that is sufficient to engage the side members 12 and 14 and hold them in or near to the erected condition shown in FIG. 1. However, this is not necessary, because a practical article of furniture generally has enough mass that the weight of a person occupying it, or the weight and size of a cushion placed atop it in the cavity will be enough to hold the device erected.

This invention thereby provides a foldable furniture construction wherein the furniture can be erected to occupy a very substantial envelope as shown in FIG. 1 and folded with the transverse member out of the way through a parallelogram to at least a near approach to a flat configuration such that the envelope occupied for shipping purposes is very much smaller.

This invention is not to be limited by the embodiments shown in the drawings and described in the description, which are given by way of example and not of limitation, but only in accordance with the scope of the appended claims.

I claim:

1. A foldable article of furniture comprising: four elongated side members, each having a pair of ends and a dimension of height, one of said side members having a lesser dimension of height than the other side members, whereby to form a sill; hinge means attached to each of said ends whereby hingedly to connect adjacent ones of said side members in a quadrilateral array, opposite side members being substantially equal in length so that said array viewed in plan is rectangular, and the array can be folded through a parallelogram configuration at least to approach a flattened configuration; a transverse member hingedly attached to the sill adjacent to the outside edge thereof, whereby the transverse member can be hingedly moved to enter the inside of the array when rectangular and be moved to a position outside of it on the opposite side of the sill from the interior of the array when flattened; and stop means on one of said side members so disposed, proportioned and arranged as to support the transverse member from below at some position of the transverse member when hingedly moved to the inside of the array when rectangular.

2. An article of furniture according to claim 1 in which the side member opposite from the side member to which the transverse member is hinged has an internal reference surface, and a recess relative to said reference surface in which the stop means comprises a surface upon which the transverse member can rest.

3. An article of furniture according to claim 1 in which the side member opposite from the side member to which the transverse member is hinged carries said stop means, said stop means comprising a stop projecting into the rectangular array.

4. An article of furniture according to claim 3 in which at least one of the side members adjacent to the side member which carries the stop has a recess located where it will receive at least part of the stop when the article of furniture is in its folded configuration.

5. An article of furniture according to claim 4 in which both of said adjacent members has such a recess.

6. An article of furniture according to claim 1 in which one of the side members adjacent to the side member to which the transverse member is hinged carries said stop means, said stop means comprising a stop projecting into the rectangular array.

7. An article of furniture according to claim 6, in which at least one of the side members adjacent to the side member which carries the stop has a recess located where it will receive at least part of the stop when the article of furniture is in its folded configuration.

8. An article of furniture according to claim 7 in which both of said adjacent members has such a recess.

9. An article of furniture according to claim 1 in which adjacent side members meet at corners, all of said corners being externally relieved, whereby two pairs of adjacent side members can be hingedly pivoted into substantial alignment.

10. An article of furniture according to claim 1 in which each hinge is a piece of flexible material.

11. An article of furniture according to claim 1 in which the transverse member is hinged to its respective side member in such a manner that it can be hinged to a position substantially parallel to the side member to which it is hinged.

12. An article of furniture according to claim 2 in which the transverse member is hinged to its respective side member in such a manner that it can be hinged to a position substantially parallel to the side member to which it is hinged.

13. An article of furniture according to claim 4 in which the transverse member is hinged to its respective side member in such a manner that it can be hinged to a position substantially parallel to the side member to which it is hinged.

14. An article of furniture according to claim 7 in which the transverse member is hinged to its respective side member in such a manner that it can be hinged to a position substantially parallel to the side member to which it is hinged.

15. An article of furniture according to claim 9 in which the transverse member is hinged to its respective side member in such a manner that it can be hinged to a position substantially parallel to the side member to which it is hinged.

16. An article of furniture according to claim 1 in which the transverse member has a dimension of width sufficiently great that the transverse member provides resistance to folding when the transverse member rests on the stop means.

17. An article of furniture according to claim 1 in which the transverse member extends beyond both sides of the sill when the furniture is in its erect configuration, whereby to form a lip for supporting an object on the transverse member, but outside the array.

* * * * *

UNITED STATES PATENT OFFICE

CERTIFICATE OF CORRECTION

Patent No. 3,981,532 Dated September 21, 1976

Inventor(s) JOHN W. CALDWELL

It is certified that error appears in the above-identified patent and that said Letters Patent are hereby corrected as shown below:

| | |
|---|---|
| In the drawings, Fig. 7 | redirect lead line 44 to terminate at tongue |
| Col. 4, line 15 (Cl. 2, line 5) | after "surface" insert --, and-- |
| Col. 4, line 34 (Cl. 7, line 1) | after "6" cancel the comma |

Signed and Sealed this

First Day of March 1977

[SEAL]

*Attest:*

RUTH C. MASON
*Attesting Officer*

C. MARSHALL DANN
*Commissioner of Patents and Trademarks*